United States Patent [19]

Pinion

[11] Patent Number: 4,798,028

[45] Date of Patent: Jan. 17, 1989

[54] DOWNSPOUT TRAP AND CLEAN OUT

[76] Inventor: John A. Pinion, 1529 Oakdale NW., Warren, Ohio 44485

[21] Appl. No.: 126,423

[22] Filed: Nov. 30, 1987

[51] Int. Cl.[4] ..... E04D 13/08

[52] U.S. Cl. ..... 52/16; 285/177

[58] Field of Search ..... 52/12, 16; 285/176, 285/177, 424; 210/445–449

[56] References Cited

U.S. PATENT DOCUMENTS

| | | | |
|---|---|---|---|
| 69,359 | 10/1867 | Mosher | 52/16 |
| 232,820 | 10/1880 | Hicks | 210/499 |
| 853,750 | 5/1907 | Whorrall | 285/176 |
| 1,190,511 | 7/1916 | Buscher | 285/177 |
| 1,351,338 | 8/1920 | Magee | 285/177 |
| 2,446,256 | 8/1948 | Young | 210/445 |
| 2,887,073 | 5/1955 | Thompson | 52/16 |
| 3,628,668 | 12/1971 | Huppert | 52/12 |
| 4,523,875 | 6/1985 | Difiore | 405/50 |

FOREIGN PATENT DOCUMENTS

| | | | |
|---|---|---|---|
| 163483 | 5/1921 | United Kingdom | 285/177 |

*Primary Examiner*—James L. Ridgill, Jr.
*Attorney, Agent, or Firm*—Harpman & Harpman

[57] ABSTRACT

Gutters and downspouts on buildings such as home conventionally communicate with drain lines for the disposal of rain water. The drain lines are sometimes connected with sewers by way of a footer drain around the foundation of the building and sometimes communicate with dry wells adjacent the building. A problem with all such downspout drainage systems is that particulate material such as leaves, small pieces of roofing and other kinds of debris tend to enter the system through the downspouts. The material accumulates in the drainage lines including the footer drains around the foundation and often fills up the dry wells with the undesirable result of storm water being introduced into the basement of the building and the resultant damage to articles in the basement as well as the foundation walls and basement floors. These problems can be eliminated by preventing the debris from entering the footer drains and/or dry wells and the downspout trap and clean out of the present invention eliminates the problem. The device comprises a simple vertically movable tubular member, the upper end of which receives the lower end of the downspout and the bottom end of which is engaged in the drain line, the device being provided with an intermediate screen. In normal position it rests in the end of the drain line or in an adapter therein and in telescopic relation to the downspout. In such position it will collect the debris and prevent it from entering the drain line. It may be simply moved up the downspout in telescopic relation so as to free its lower end from the drain line whereupon it can be removed from its normal position and the debris emptied and the device replaced.

5 Claims, 1 Drawing Sheet

DOWNSPOUT TRAP AND CLEAN OUT

BACKGROUND OF THE INVENTION

1. Technical Field

This invention relates to roof drainage systems incorporating gutters and downspouts and drain lines and more particularly to a debris trap and clean out establishing a removable connection between a downspout and a drain line.

2. Description of the Prior Art

U.S. Pat. No. 69,359 shows a water spout cut off in which a section of a downspout is movable between side by side receptacles, one of which includes a filter or a strainer. U.S. Pat. No. 2,887,073 discloses a downspout as a part of a gutter cleaning system with a portion of the downspout being enlarged so as to receive a wire mesh basket which can be removed through an access opening provided with a door. U.S. Pat. No. 3,628,668 discloses an attachment positioned between a drain line and a downspout having an angularly disposed screen therein and an opening adjacent the screen. A slidable cover sleeve 11 surrounds the device in the area of the opening, the sleeve being larger than the portion of the device having the opening therein so that water from the downspout flowing outwardly of the opening as would occur when the screen is covered with debris will be confined within the sleeve and directed downwardly into the drain pipe.

U.S. Pat. No. 4,523,875 relates to an auxiliary drainage system positioned around the foundation of a building and communicating with the gutters and downspouts and discloses a leaf trap built into the downspouts including a curved screen, the lower end of which is adjacent an opening which is provided with a movable closure.

The present invention eliminates the problems associated with the prior art devices, particularly with respect to eliminating any openings and hinged doors and the like and provides a simple, very inexpensive screened trap and clean out in the form of a tubular member telescropically engaged on the lower end of a downspout so as to be readily removable and replaceable with respect thereto where it forms a direct connection with the drain line below the downspout.

SUMMARY OF THE INVENTION

A downspout trap and clean out comprises a vertically disposed tubular body member having an upper portion of a size enabling it to be moved telescopically over the lower end of a downspout and a lower portion of a size engageable in a drain line, the lower portion having a screen therein, the tubular body member normally forming a tubular connection between the downspout and the drain line.

DESCRIPTION OF THE PREFERRED EMBODIMENT

Figure 2:
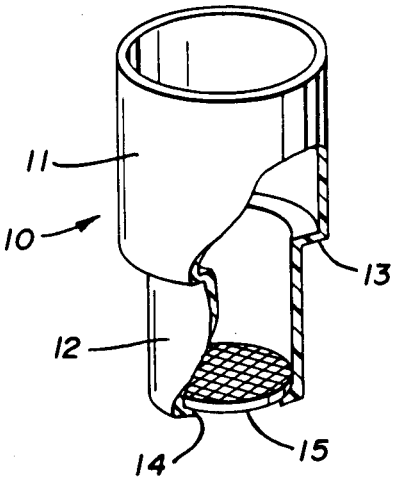
FIG. 2 is an enlarged perspective elevation of the downspout trap and clean out.

In its simplest form the downspout trap and clean out as illustrated in FIG. 2 of the drawings comprises a vertically disposed tubular body member 10 which may be of circular, rectangular or square cross section and having an upper portion 11 of a known diameter and a lower portion 12 of a diameter less than that of the upper portion 11, the upper portion 11 and the lower portion 12 being joined to one another by a connecting flange 13. The lower end of the lower portion 12 of the tubular body member 10 is provided with an inturned flange 14 on which a screen 15 is positioned.

Figure 1:
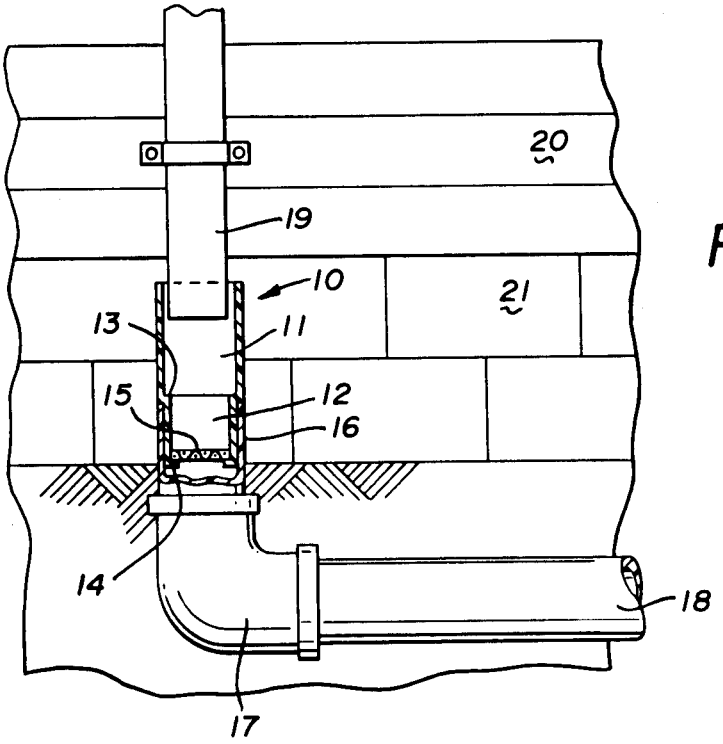
FIG. 1 is a side elevation with parts broken away and parts in cross section illustrating the downspout trap and clean out positioned between a downspout and a drain line.

By referring now to FIG. 1 of the drawings, it will be seen that the lower portion 12 of the downspout trap and clean out is positioned in the open end of a vertically arranged drain pipe 16 which communicates with a fitting 17 on a drain line 18. The upper portion 11 of the tubular body member 10 is telescopically engaged over the lower end of a downspout 19 which is attached to the outside wall of a building 20 which is supported by foundation blocks 21. The drain line 18 leads to a point of disposal of rain water moving down the downspout 19 as from gutters, not shown.

As illustrated in FIG. 1 of the drawings, leaves and other debris moving down the downspout 19 will be trapped by the screen 15 and prevented from entering the drain pipe 16, the fitting 17 and the drain line 18.

Those skilled in the art will observe that the downspout 19 is spaced sufficiently from the outside wall 20 of the building to permit the tubular body member 10 to be moved vertically from the position illustrated in FIG. 1 of the drawings upwardly telescopically around the lower end of the downspout 19 sufficiently that the lower end of the lower portion 12 of the tubular body member 10 moves to a position above the upper open end of the drain pipe 16 whereupon the tubular body member can be tilted sideways and moved downwardly away from the downspout 19 to become completely disengaged therefrom. Debris on the screen 15 may then be removed and the device replaced and it will be seen that when it is in operating position as illustrated in FIG. 1 of the drawings, it forms a vertical extension of the drain pipe 16 as its lower portion 12 is positioned securely therein and its upper portion 11 is securely positioned around the lower portion of the drainspout 19.

It will occur to those skilled in the art that its self-securing positioning as a part of the downspout and drain line system results from its telescopic engagement of each of its ends with respect to the drain pipe 16 and the downspout 19.

As illustrated and described hereinbefore, the tubular body member 10 may be inexpensively and easily molded of polyvinyl chloride or a similar synthetic resin material in either a circular cross sectional shape, a modified rectangular cross sectional shape, or a square cross sectional shape and it will be seen that the over-all vertical height of the tubular body member must be such that the upper portion 11 can move upwardly telescopically over the downspout 19 sufficiently that the lower portion 12 and its lower end with the inturned flange 14 and screen 15 will move out of the open upper end of the drain pipe 16 in which it is normally positioned. The tubular body member is accordingly formed with the uppermost portion 11 thereof being of a vertical height more than double the vertical height of the lower portion 12.

Figure 3:
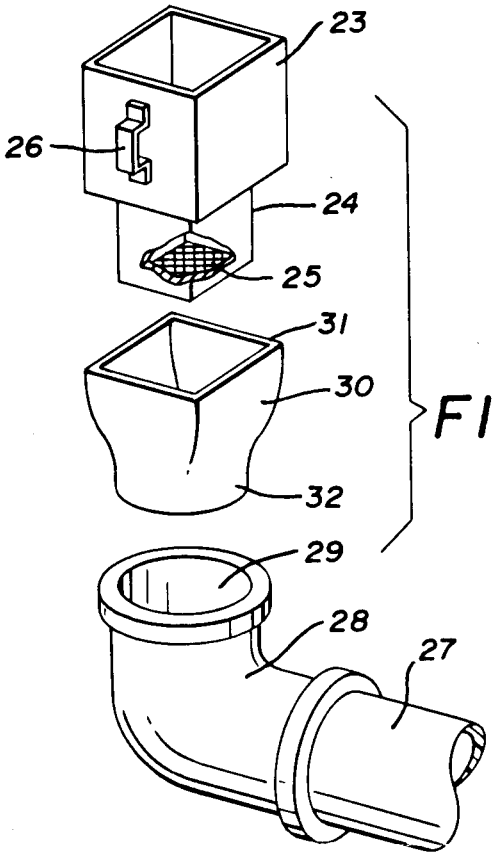
FIG. 3 is an exploded perspective elevation of a modified form of the downspout trap and clean out and an adapter used therewith.

Modifications of the device will occur to those skilled in the art and one such modification is illustrated in the exploded perspective view comprising FIG. 3 of the drawings and by referring thereto it will be seen that a downspout trap and clean out is illustrated as comprising a cross sectionally square upper portion 23 of a known size having a lower portion 24 of a smaller size, the lower portion 24 having a screen 25 in its lowermost end. A handle 26 is formed on or attached to the upper portion 23 and the illustrated device may be molded of polyvinyl chloride or other suitable synthetic resin or it may be formed of sheet metal and like the form of the invention illustrated in FIG. 2 of the drawings and hereinbefore described, the upper portion 23 and the lower portion 24 are joined by an inturned flange which forms a watertight connection between the upper and lower portions 23 and 24 respectively.

As illustrated in FIG. 3 of the drawings, a conventional tubular drain pipe 27 with an L-shaped fitting 28 presents a circular opening 29 and therefore requires an adapter 30 to establish a suitable fluid conducting connection. The upper portion 31 of the adapter 30 is cross sectionally square and the lower portion 32 of the adapter 30 is cross sectionally circular and it will be seen that the adapter 30 in effect replaces the section of drain pipe 16 in which the device as illustrated in FIG. 1 of the drawings is positioned. The adapter 30 can be molded of polyvinyl chloride or other suitable synthetic resin or it may be formed of sheet metal and when positioned in the circular opening 29 of the L-shaped fitting 28 it will receive the lower portion 24 of the modified form of the invention.

It will be understood that the modified form of the invention will receive cross sectionally circular rectangular or enlarged cross sectionally square downspouts in the same manner as hereinbefore described in connection with FIG. 1 of the drawings.

Although but two embodiments of the present invention have been illustrated and described, it will be apparent to those skilled in the art that other changes and modifications may be made therein without departing from the spirit of the invention and having thus described my invention what I claim is:

1. In gutter and downpout drainage apparatus of the type communicating with a drain line; an improved downspout trap and clean out apparatus, the improvement comprising; a vertically disposed integral tubular body member formed in upper and lower portions of different lengths and different diameters, screen means in said lower portion, said upper portion being of a known diameter and length sufficient to telescopically engage over a lower end of said downspout in first and second positions and said lower portion being of a known diameter and length capable of being telescopically engaged in an upper end of said drain line in said first position, whereby said tubular body member may be moved vertically to said second position where said lower portion is free of said drain line so as to permit the tubular body member to be removed from said downspout.

2. The improvement in downspout trap and clean out apparatus set forth in claim 1 wherein said upper and lower portions are of cross sectionally circular configurations.

3. The improvement in downspout trap and clean out apparatus set forth in claim 1 wherein said upper and lower portions of said tubular body member are of known vertical heights and the height of the upper portion is at least double the known height of said lower portion.

4. The improvement in downspout trap and clean out apparatus set forth in claim 1 and wherein said tubular body member is integrally molded of synthetic resin.

5. The improvement in downspout trap and clean out apparatus set forth in claim 1 and wherein said integral tubular body member is a metal structure forming a vertical water path.

* * * * *